US007604014B2

(12) United States Patent
Paintner

(10) Patent No.: US 7,604,014 B2
(45) **Date of Patent: *Oct. 20, 2009**

(54) DISHWASHER

(75) Inventor: Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 521 days.

This patent is subject to a terminal disclaimer.

(21) Appl. No.: 10/561,007

(22) PCT Filed: Jul. 2, 2004

(86) PCT No.: PCT/EP2004/007250

§ 371 (c)(1),
(2), (4) Date: Dec. 16, 2005

(87) PCT Pub. No.: WO2005/018408

PCT Pub. Date: Mar. 3, 2005

(65) Prior Publication Data

US 2007/0089763 A1 Apr. 26, 2007

(30) Foreign Application Priority Data

Jul. 30, 2003 (DE) ..... 103 34 792

(51) Int. Cl.
*A47L 15/42* (2006.01)

(52) U.S. Cl. ..... 134/105; 134/56 D; 134/58 D; 134/90; 134/57 D

(58) Field of Classification Search ..... 134/105
See application file for complete search history.

(56) References Cited

FOREIGN PATENT DOCUMENTS

| | | |
|---|---|---|
| DE | 30 21 746 | 12/1981 |
| DE | 198 13 924 | 9/1999 |
| EP | 1 342 828 | 9/2003 |
| FR | 1368101 | * 6/1964 |
| GB | 2 375 812 | 11/2002 |
| GB | 2375812 | * 11/2002 |

* cited by examiner

*Primary Examiner*—Michael Barr
*Assistant Examiner*—Jason P Riggleman
(74) *Attorney, Agent, or Firm*—James E. Howard

(57) ABSTRACT

A dishwasher having a washing basket comprises a guidance system that is connected to the washing basket in an air-guiding manner and contains at least one Peltier element. The Peltier element is used for cooling and thereby drying, and also for heating air guided through from the washing basket.

8 Claims, 1 Drawing Sheet

DISHWASHER

Figure 1:
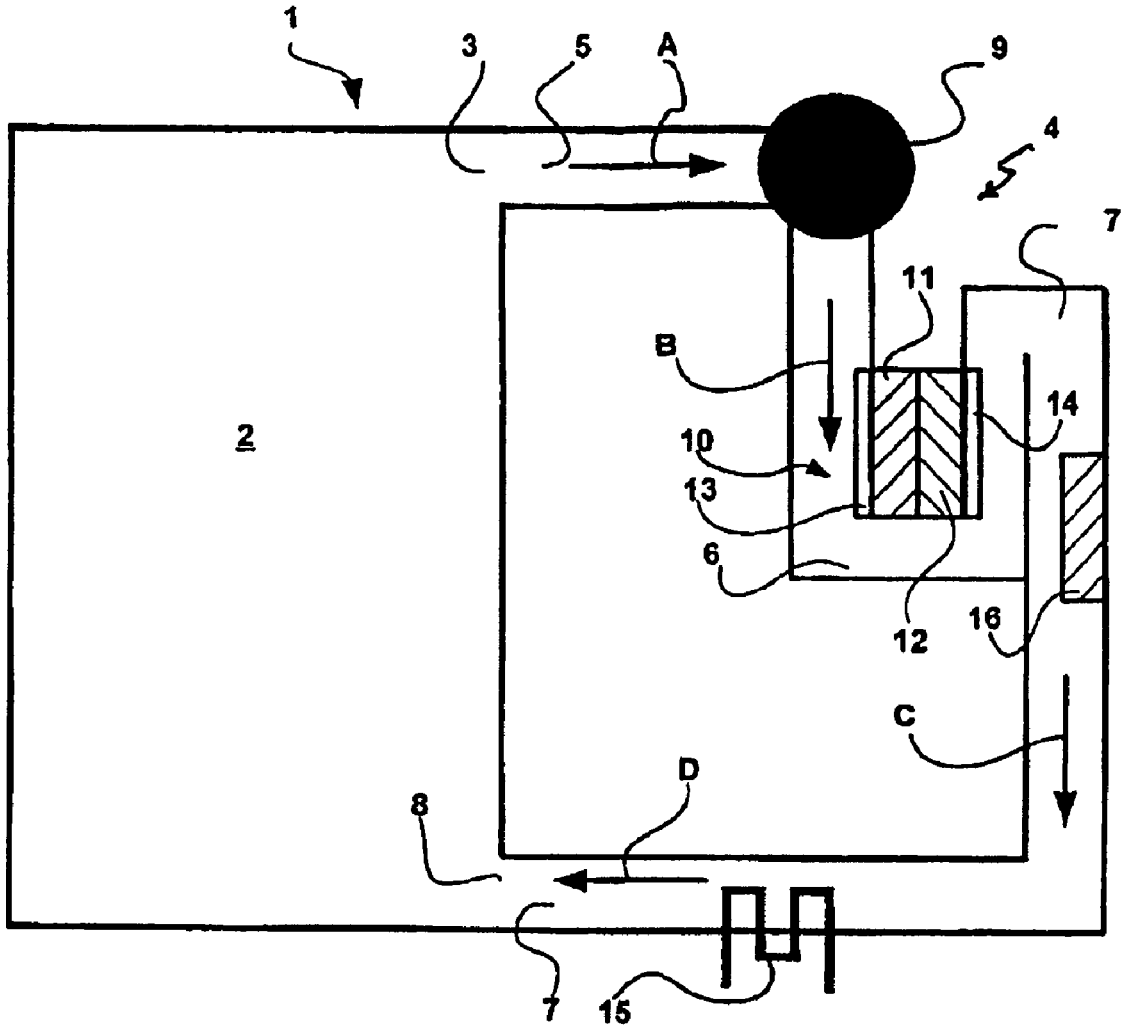

The invention relates to a dishwasher comprising a washing basket.

It is known that a dishwasher has a washing method whose program run consists of at least one partial program step "pre-wash", a partial program step "clean", at least one partial program step "intermediate rinse", a partial program step "clear rinse" and a partial program step "dry". To increase the cleansing effect, the washing liquid is heated before or during a partial program step. The washing liquid is usually heated by means of electrical heaters. Various drying systems are known for drying the objects to be washed in a dishwasher.

For example, the objects to be washed can be dried by own-heat drying if the washing liquid is heated in a partial program step "clear rinse" and thus the objects to be washed which have undergone a hot clear rinse are dried by themselves by the self-heat of the objects to be washed which has thus built up during the drying process. In order to achieve this own-heat drying, the washing liquid is heated to a certain temperature in the "clear rinse" partial program step and applied to the objects to be washed by means of spraying devices. As a result of the relatively high temperature of the washing liquid in the "clear rinse" partial program step of usually 65° C. to 75° C., it is achieved that a sufficiently large quantity of heat is transferred to the objects to be washed so that water adhering to said objects to be washed vaporises as a result of the heat stored in the objects to the washed.

In a further known drying device, a separate heat source, e.g. a hot air fan, is used in the washing basket to heat the moist air mixture during the drying process so that the air in the washing basket can absorb a larger quantity of moisture.

Dishwashers are known in which the moist air is vented outwards. This is disadvantageous since the surrounding kitchen furniture is damaged.

Thus, further dishwashers are known in which the moist air is passed over condensing surfaces on which the moisture condenses before being guided out. This condensation is either passed into the washing basket or into special collecting containers.

A method for operating a dishwasher is known from DE 30 21 746 A1, wherein a heat exchanger connected to the washing basket in a heat-conducting manner is supplied with cold fresh water during a partial program step "drying". A condensing surface is thereby produced on the inside of the washing basket on which moisture condenses and the condensation formed remains in the washing basket. Since the temperature difference between the moist air and the fresh water which is poured in, is relatively small, and the quantity of fresh water is heated continuously, this results in the disadvantage that the condensation of the moist air lasts for a long time and continually becomes smaller so that the discharge of moist air from the dishwasher increases and the duration of the partial program step "drying" is long with a moderate drying result.

A disadvantage in the heating systems described above according to the prior art described further above is that the heating of the washing liquid is associated with a high energy requirement and the thermal energy required for each heating phase must be produced anew by means of electrical heating elements. The known heating systems also have the disadvantage that the heating of the washing liquid in the "clear rinse" partial program section and the processes in the "drying" partial program section are themselves associated with a high energy requirement and the thermal energy required is lost after the drying process.

It is thus the object of the present invention to provide a dishwasher which can be used to efficiently clean and dry the objects to be washed in the washing basket from an economical point of view and to keep the related energy costs as low as possible.

This object is solved by the dishwasher according to the invention having the features according to claim 1. Advantageous further developments of the present invention are characterised in the dependent claims.

The dishwasher according to the invention comprises a guidance system that is connected to the washing basket in an air-guiding manner and contains at least one Peltier element, said Peltier element being used for cooling and thereby drying, and also for heating air guided through the washing basket.

As a result of using a Peltier element, substantially less heating of the items to be treated is required compared with the prior art, e.g. in dishwashers in the "clear rinse" partial program step. This means a substantial energy saving. As a result of the cooling of the air, its moisture absorption capacity is lowered and the moisture fraction of the air is precipitated as condensate. As a result of heating of the air, its moisture absorption capacity is increased again on each passage through the guidance system which results in improvement in the drying result and/or a shortening of the drying time. In the closed air system, any exchange of contaminated air from the environment is completely eliminated, preventing any back contamination of the treated objects. The present invention provides a dishwasher which can be used to efficiently clean and dry objects to be washed in the washing basket and thus keep the related energy costs as low as possible.

According to a preferred feature of the invention, in the at least one "drying" partial programme section air from the washing basket is passed into the guidance system and back into the washing basket, whereby the aforementioned advantages in the dishwasher according to the invention are used as prescribed.

In a particularly advantageous fashion, the washing container has an outlet with a pipe to one part of the Peltier element, a pipe from one part of the Peltier element to the other part of the Peltier element and an inlet with a pipe from the other part of the Peltier element, wherein a fan is arranged in the pipe to one part of the Peltier element which supplies at least some of the air in the washing basket to the guidance system at least temporarily. In the closed air system an exchange of contaminated air from the environment is completely excluded, which prevents any back contamination of the items to be treated. The fan can easily be controlled so that the use of the Peltier element can be controlled precisely and simply. In addition, the fan increases the effect of the Peltier element since the air to be passed through is conveyed more rapidly.

According to a further preferred feature of the invention, the air is cooled by means of the Peltier element. The actual function of a Peltier element, cooling whilst removing the absorbed thermal energy, is thus used. As a result of the cooling of the air, its moisture absorption capacity is lowered and the moisture fraction of the air is precipitated as condensate.

According to a further preferred feature of the invention, the air is heated by means of the Peltier element. The further function of the Peltier element, which is provided anyway, the transported heat absorbed during cooling of the moist air and during condensation of the moisture from the moist air, is used for further energy saving.

According to an advantageous embodiment of the invention, a heater is arranged in the pipe between the other part of the Peltier element and the inlet. Should the heating of the air by the Peltier element not be sufficient, the air is additionally heated by a heater to ensure the drying function. Despite the additional energy consumption for the heating, a saving of energy is achieved compared with the previously described prior art.

According to a further advantageous embodiment of the invention, a condenser is arranged in the pipe between the outlet and the one part of the Peltier element or alternatively in the pipe between one part of the Peltier element and the other part of the Peltier element. Should the removal of moisture from the air by the heat pipe not be sufficient, the air is additionally passed by a condenser which undertakes the lacking removal of moisture to ensure the drying function.

The invention is explained hereinafter with reference to the exemplary embodiment of a dishwasher according to the invention shown in the drawings.

The single FIGURE is a schematic diagram showing a dishwasher 1 according to the invention comprising a washing basket 2 containing crockery baskets not shown for arranging objects to be washed, which are not shown.

According to the invention, the dishwasher 1 has a guidance system 4 connected to the washing basket 2 in an air-guiding manner and containing at least one Peltier element 10, said Peltier element 10 being used, as is explained in detail further below, on the one hand for cooling and thus for drying and also on the other hand for heating air passed through from the washing basket 2.

As is known, a Peltier element 10 is a heat pump which is used to extract heat from one region—this is cooled—and to transport it to another region—this is heated, the heat being guided at high speed and in a large quantity from one part 11—the so-called "cold side"—of the Peltier element 10 to the other part 12—the so-called "warm side"—of the Peltier element. For this purpose, electric current is applied to the Peltier element. Thus, if the moist air is fed to the "cold side" 11 of the Peltier element 10, this cools the moist air and thus reduces the moisture absorption capacity of the moist air, causing the moisture contained in the moist air to condense. The "cold side" 11 of the Peltier element 10 thus extracts the heat (sensible heat) from the moist air and also absorbs the condensation heat produced (latent heat) and transports the heat to the other part 12—to the "warm side" of the Peltier element 10.

The washing container 2 has an outlet 3 which leads to the guidance system 4 with a pipe 5 to one part 11 of the Peltier element 10, with a pipe 6 from one part 11 of the Peltier element 10 to the other part 12 of the Peltier element and with a pipe 7 from the other part 12 of the Peltier element 10 to an inlet 8 of the washing basket 2, where a fan 9 is arranged in the pipe 5 to one part 11 of the Peltier element 10 which supplies at least some of the air in the washing basket 2 to the guidance system 4 at least temporarily.

In the closed air guidance system 4, exchange of contaminated air from the environment is completely eliminated, which prevents back contamination of the treated objects.

A heater 15 is arranged in the pipe 7 from the other part 12 of the Peltier element 10 to the inlet 8 of the washing basket 2. Should the heating of the air by the Peltier element 10 not be sufficient, the air is additionally heated by the heater 15 to ensure the drying function. Despite the additional energy consumption for the heater 15, a saving of energy is achieved compared with the prior art.

A condenser 16 is arranged in the pipe 6 from one part 11, the "cold side" of the Peltier element 10 to the other part 12, to the "warm side", of the Peltier element 10. Alternatively, it is possible to have an arrangement of the condenser in the pipe to one part, to the "cold side" of the Peltier element. Should the removal of moisture from the air by the Peltier element 10 not be sufficient, the air is additionally passed by the condenser 16 which undertakes the lacking removal of moisture to ensure the drying function. This condenser 16 is in thermal contact with the surroundings.

The method implemented during operation of the dishwasher 1 according to the invention is described in the following.

It is known that a dishwasher 1 has a washing method whose program run consists of at least one partial program step "pre-wash", a partial program step "clean", at least one partial program step "intermediate rinse", a partial program step "clear rinse" and a partial program step "dry". According to the invention, during the partial program step "dry", air from the washing basket 2 is passed through the guidance system 4 and back into the washing basket 2 again. The fan 9 is switched on for this purpose. The air path is indicated by the arrows A, B, C and D. A large amount of thermal energy is extracted on the "cold side" of the Peltier element from the air guided from the fan 9 via the pipe 5 to one part 11—to the "cold side" of the Peltier element 10 so that this is very strongly cooled and since cold air has a substantially lower moisture absorption capacity, a large fraction of moisture condenses in this case. Heat conducting fins 13 are provided for heat conduction of the air to the Peltier element 10. The Peltier element 10 guides the heat extracted from the moist air (sensible heat) and the heat formed during condensation (latent heat) to its other part 12—the "warm side" of the Peltier element 10. For this purpose electrical current is applied to the Peltier element 10. The now very dry air is passed via the pipe 6 from one part 11 of the Peltier element 10 to the other part 12 of the Peltier element 10 and is heated there. Heat conducting fins 14 are provided for good heat conduction from the Peltier element 10 to the air. The air which is now heated and very dry passes via the pipe 7 from the other part 12 of the Peltier element 10 to the inlet 8 of the washing basket 2 and thus back into the washing basket 2 again. The heated air led into the washing basket 2 is now substantially drier and has a high absorption capacity for moisture. It rises upwards in the washing basket 2 and absorbs the residual moisture on the objects to be washed. As described above, it is now fed back to the Peltier element 10 again.

As a result of using a Peltier element 10, substantially less heating of the objects to be treated is required compared with the prior art, in the exemplary embodiments described, only by about 50° C. or possibly even lower in the "clear rinse" partial program step. This means a substantial saving of energy. As a result of the heating of the air, its moisture absorption capacity is increased again on each passage through the guidance system 4 which results in an improvement of the drying result and/or shortening of the drying time.

The present invention thus provides a dishwasher 1 which can be used to efficiently clean and dry the objects to be washed in the washing basket 2 from an economical point of view and to keep the related energy costs as low as possible.

The invention claimed is:

1. A dishwasher comprising:

a washing basket including crockery baskets for arranging objects to be washed; a spraying device for applying a rinsing liquid to the objects to be washed; and an air guidance system defining a closed air flow path extending from a first portion of the washing basket to a second portion of the washing basket, the air guidance system being connected to the washing basket in fluid communication therewith for receiving air in a first condition from the washing basket and for delivering air in a second condition, with the second condition being different from the first condition, from the guidance system to the washing basket; and at least one Peltier element operatively associated with the air guidance system and disposed within the closed air flow path in a manner wherein a cooling side of the Peltier element is disposed within the air flow path and is configured for removing heat energy from and thereby drying air in the first condition passing thereacross, and a second warming side of the Peltier element is disposed downstream of the first cooling side of the Peltier element in the closed air path for adding heat energy to the air dryed by the cooling side of the Peltier element passing thereacross resulting in air in the second condition for delivery to the washing basket.

2. The dishwasher according to claim 1, wherein the dishwasher is configured for using the guidance system during at least one drying partial program section of a washing program that is performed by the dishwasher to guide air from the washing basket into the guidance system and back into the washing basket.

3. The dishwasher according to claim 1, wherein the washing basket includes an outlet in operative communication with a pipe within the air guidance system in communication with the cooling side of the Peltier element, the guidance system includes a pipe communicating the cooling side of the Peltier element with the heating side of the Peltier element, and the washing basket includes an inlet in operative communication with a pipe communicated with the heating side of the Peltier element and further comprising a fan arranged in the pipe communicating the washing basket with the cooling side of the Peltier element, the fan being operable to move air from the washing basket to the guidance system.

4. The dishwasher according to claim 1, wherein the cooling side of the Peltier element is configured for cooling air within the guidance system from the washing basket.

5. The dishwasher according to claim 1, wherein the heating side of the Peltier element is configured for heating air within the guidance system from the washing basket.

6. The dishwasher according to claim 1 and further comprising a heater arranged in the pipe operatively associated with the inlet of the washing basket in operative communication with the heating side of the Peltier element.

7. The dishwasher according to claim 1 and further comprising a condenser arranged in the pipe of operatively associated with the outlet of the washing basket and the cooling side of the Peltier element.

8. The dishwasher according to claim 1 and further comprising a condenser arranged one of in the pipe extending between the cooling side of the Peltier element and the heating side of the Peltier element and in the pipe downstream of the Peltier element.

* * * * *

UNITED STATES PATENT AND TRADEMARK OFFICE

CERTIFICATE OF CORRECTION

PATENT NO. : 7,604,014 B2
APPLICATION NO. : 10/561007
DATED : October 20, 2009
INVENTOR(S) : Kai Paintner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 829 days.

Signed and Sealed this

Fifth Day of October, 2010

David J. Kappos

David J. Kappos
*Director of the United States Patent and Trademark Office*